United States Patent [19]

Fortsch

[11] 3,993,109

[45] Nov. 23, 1976

[54] STRAP TIGHTENING AND SEVERING TOOL

[75] Inventor: William A. Fortsch, Livingston, N.J.

[73] Assignee: Thomas & Betts Corporation, Elizabeth, N.J.

[22] Filed: Jan. 16, 1976

[21] Appl. No.: 649,633

[52] U.S. Cl. ..... 140/123.6; 140/93.2

[51] Int. Cl.[2] ..... B21F 9/02

[58] Field of Search..... 140/93 A, 93.2, 123.6; 254/51

[56] References Cited

UNITED STATES PATENTS

| | | | |
|---|---|---|---|
| 3,047,945 | 8/1962 | Logan | 140/123.6 |
| 3,645,302 | 2/1972 | Caveney et al. | 140/93.2 |
| 3,810,499 | 5/1974 | Benfer | 140/123.6 |

*Primary Examiner*—Lowell A. Larson
*Attorney, Agent, or Firm*—David Teschner; Jesse Woldman

[57] ABSTRACT

The invention is directed to a hand supported, hand operated tool for drawing up the loop formed by a self-locking strap about a plurality of articles to be bundled. A slide means translates across a stationary base member bearing at one end pawl means for grasping the strap and along its length finger grips to cause translation of the slide means. An internally confined return spring returns the slide means to an initial position and opens the pawl means. The repetition of the cycle permits the pawl means to grasp the strap at a different location and further translation of the slide means causes further tightening of the strap loop. When the operator determines that sufficient tension exists in the loop, he merely rotates the tool in a clockwise or counterclockwise direction about its longitudinal axis and causes the strap body portion to engage the sharpened sides of the slot in the tool nosepiece causing the strap body portion to be severed.

4 Claims, 14 Drawing Figures

STRAP TIGHTENING AND SEVERING TOOL

BACKGROUND OF THE INVENTION

1. Field of the Invention

The invention is used for bundling individual articles such as rods, tubes or the like to make their storage, handling, etc. more simple. The invention finds particular utility in the field of bundling individual conductors into cables of such conductors.

2. Description of the Prior Art

Many of the prior art devices for applying straps to conductors were large and complex due to the inclusion within the tool of mechanisms to measure the tension within the strap applied to the bundle and to cause locking of the strap and severing of the excess portion of the strap body beyond the head member once a preset or predetermined tension in the strap had been reached.

Where it was not necessary to know the tension in the strap with any degree of accuracy and where operator judgement as to the strap loop tightness would suffice, simpler tools could be employed. One of such simpler tools is shown in U.S. Pat. No. 3,810,499 issued May 14, 1974 to David Van Dike Benfer entitled "Bundle Tie Tool". This patent shows a manual tool for applying straps about articles to be bundled to a tightness generally determined by the operator. The tool includes a separate cutter lever which must be operated once a prescribed arrangement of the tool parts is reached to sever the excess portion of the strap. If the operator feels the strap loop is tight enough but the tool parts are not in a particular position the strap loop must be further tightened until the tool parts are in the prescribed position and the cutter lever operated.

SUMMARY OF THE INVENTION

The present invention offers a further hand held, hand operated tool which overcomes the difficulties noted above with respect to the described tool. In the instant tool the operator may sever the excess strap length at any time desired regardless of the relative positions of the tool parts.

In the instant invention, a base portion has a stock at one end, a nose piece at the other end with a generally planar portion therebetween. Guide means extend normal to the plane of the slide means which has complementarily shaped receivers in its central, planar portion. Intermediate the slide means ends are finger grips by which an operator can, with the stock of the base portion against the thumb of his hand, for example, cause the slide means to translate to a second position from an initial position established by a return spring coupled between and within the base portion and slide means.

At the second end of the slide means is a pawl assembly which protrudes into a recess to grasp a strap body inserted therein once the slide means translates towards its second position. In the initial position, a pawl release, fashioned as part of the nose piece, insures that the pawl means will be ineffective and a strap body can be easily inserted removed or moved along the recess without impediment.

A strap is looped about the articles to be bundled and introduced through a slot in the nose piece to the recess in the front end of the slide means. The slide means is translated towards its second position releasing the pawl to its engagement position causing the strap body to be drawn into the tool. Since the slide means has a definite stroke length the strap loop may not be tightened sufficiently in one stroke and the slide means is allowed to move forward allowing the pawl to move along the strap surface without affecting strap position until the initial position is reached and the pawl means opens entirely. The strap can now be regrasped by the pawl and tightened further.

Anytime the operator determines that the strap is as tight about the bundle as desired further movement of the slide means is terminated and at that point cutoff of the excess portion of the strap beyond the head face is accomplished by rotating the entire tool in either a clockwise or counterclockwise direction about the longitudinal axis of the tool so as to bring the strap body portion into contact with the sharpened edges, which define the slot in the nose piece, and continuing such rotation until severance is complete. It is therefore an object of this invention to provide a tool for tightening a strap.

It is another object of this invention to provide a tool for tightening a strap and severing the excess of the strap body beyond the head face.

It is another object of this invention to provide a tool for tightening a strap and which can be made to selectively sever the excess of the strap body beyond the head face under full operator control.

It is yet another object of this invention to provide a hand held, hand operated tool for tightening a strap.

It is still another object of this invention to provide a hand held, hand operated tool for tightening a strap and which can be selectively operated under full operator control to sever the excess of the strap body beyond the head face.

Other objects and features of the invention will be pointed out in the following description and claims and illustrated in the accompanying drawings, which disclose, by way of example, the principle of the invention and the best mode which has been contemplated for carrying it out.

BRIEF DESCRIPTION OF THE DRAWINGS

In the drawings in which similar elements are given similar reference characters.

DESCRIPTION OF THE PREFERRED EMBODIMENT

Figure 12:
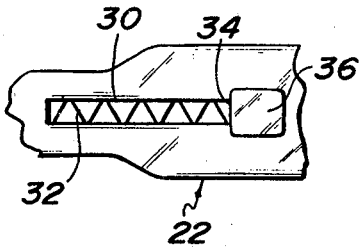
FIG. 12 is a fragmentary top plan view of the tool of FIG. 1, with the slide portion removed from the base portion and showing the slide portion return spring.

Turning now to FIGS. 1, 2, 13 and 14 a tool 20 constructed in accordance with the concepts of the invention can now be set forth. Tool 20 has a base portion 22 terminating at its right end in a stock 24 curved to fit the contours of the users hand, for example, at the joint between his thumb and index finger on either the left or right hand and at its opposite end in a nose zone comprised of two upstanding members 26 coupled by a transverse member 38. The base portion 22 is generally planar except for the recess 30, as is better seen in FIG. 12, for receipt therein of the slide portion return spring 32, as will be more fully described below. At end wall 34 of the recess 30 provides one end stop for the spring 32.

Figure 3:
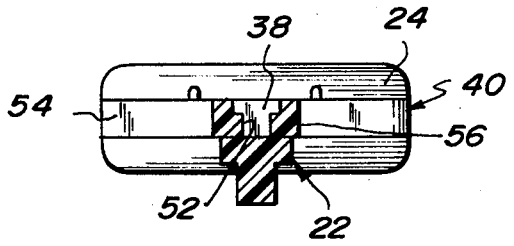
FIG. 3 is a sectional view of the tool of FIG. 2 taken along the line 3—3 of FIG. 2.

Protruding above the planar surface of the base portion 22 are also a pair of Tshaped guides 36 and 38, guide 38 being best seen in FIG. 3, and whose function will be described below.

Figure 1:
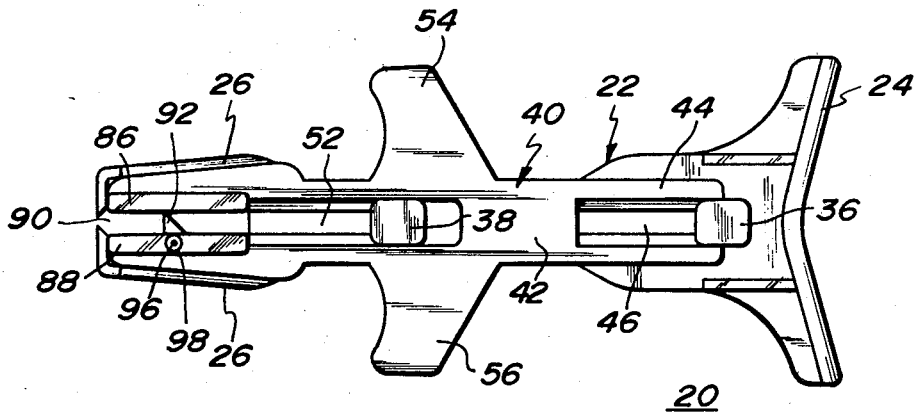
FIG. 1 is a top plan view of a tool constructed in accordance with the concepts of the invention.
Figure 2:
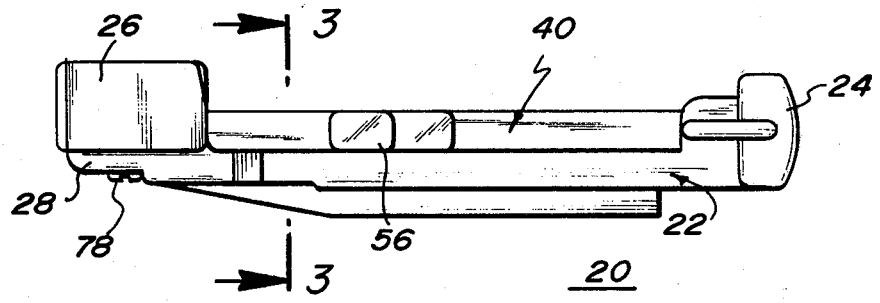
FIG. 2 is a slide elevation of the tool of FIG. 1.

Positioned above the base portion 22 is slide portion 40 having a generally planar body portion 42 terminating at its right end 44 in a stepped slot 46 extending from its top surface as viewed in FIG. 1 and a slide portion 40 return spring recess 48 whose front surface 50 acts as the second end stop for the slide portion return spring 32. A second stepped slot 52 extends at the left end of slide portion 40 and receives therein the guide 38, as is best seen in FIG. 3.

When slide portion 40 is assembled to base portion 22, guide 38 rides within the stepped slot 52 and the guide 36 rides within the stepped slot 46. The slide portion 40 return spring 32 is confined within the recess 30 in base portion 22 and recess 48 in slide portion 40 and between end walls 34 and 50 of the base portion and slide portion respectively. Since spring 32 is a compression spring, it tends to keep slide portion 40 to the left, as shown in FIG. 1. The guides 36, 38 with their respective stepped slots 46, 52 keep the slide portion 40 and base portion 22 assembled without interferring with relative movement between the pieces.

Figure 14:
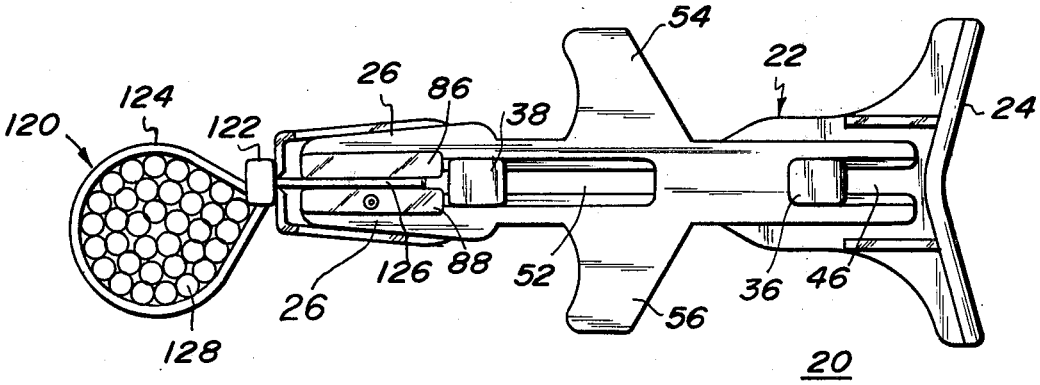
FIG. 14 is a top plan view of the tool of FIG. 1 in the fully operated condition with the slide portion moved to the extreme right position on the base portion.

Extending outwardly from the lateral margins of the slide portion 40 are finger grips 54 and 56 about which, for example, an operator can conveniently position his index and middle fingers, respectively of either his left or right hand. Thus, with the tool 20 lying in the palm of the operators hand, and the stock positioned at the joint between the thumb and index finger, the operator can move the slide portion 40 to the right of FIG. I, as shown in FIG. 14, merely by applying a slight pressure to the finger grips 54 and 56 with the index and middle fingers. In that the tool is completely symmetrical and the strap enters the slot between members 86, 88, as shown, the tool 20 can be used equally effectively and easily in either hand.

Figure 4:
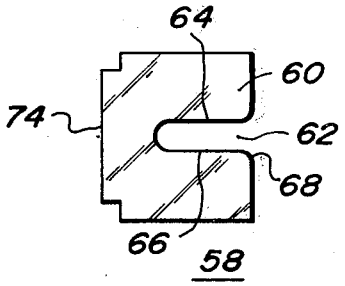
FIG. 4 is a front elevation of the nose piece of the tool of FIG. 1.
Figure 5:
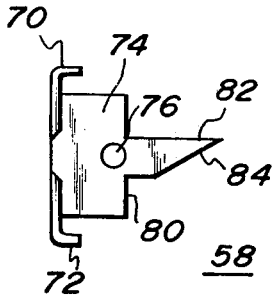
FIG. 5 is a side elevational view of the nose piece of FIG. 4 with the tool in position of FIG. 2.

At the left end of the base zone, as viewed in FIG. 1, is a nose piece 58, best seen in FIGS. 4 and 5. Nose piece 58 has a front plate 60 which contains a slot 62 open to the right side, as viewed in FIG. 4. The edges 64, 66 which define the slot 62 are sharpened so that they can be used as knives to nick and cut the strap material brought into contact therewith. The slot 62 is so dimensioned that a strap can normally pass therethrough without harmful contact with the sharpened edges 64, 66. The slot 62 lead in is chamfered as at 68 to make insertion of a strap into slot 62 easy and the upper and lower marginal areas of front plate 60 are contoured as at 70, 72 to provide a smooth mating with upstanding members 26.

A transverse plate 74 is arranged to overlie transverse member 28 of the nose zone of the base portion 22 and has an aperture 76 to receive therein a fastener 78 (see FIG. 2) to permit nose piece 58 to be fastened to the transverse member 28 of the base portion 22. Extending from marginal edge 80 of transverse plate 74 is a pawl operating lever 82 having an inclined leading edge 84, the function of which will be set forth below.

At the leftmost end of slide portion 40 is the pawl zone composed of two upstanding members 86, 88 and joined by a transverse member 90. The upstanding members 86, 88 are spaced apart sufficiently to permit the thickness of a strap to pass easily therebetween. An aperture 92 partly in upstanding member 88 and transverse member 90 is arranged to permit a pawl 94, as shown in FIGS. 6 to 9, to move from a non engaging to a strap engaging position.

Figure 6:
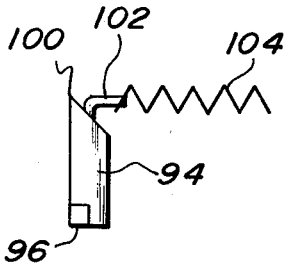
FIG. 6 is a side elevation of the pawl assembly of the tool of FIG. 1 as viewed in a direction from the top of FIG. 1.
Figure 7:
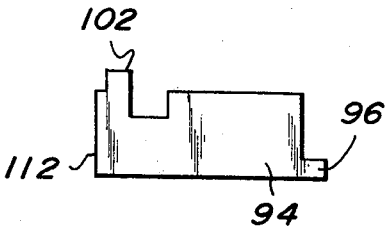
FIG. 7 is a front elevation of the pawl member of FIG. 6.
Figure 9:
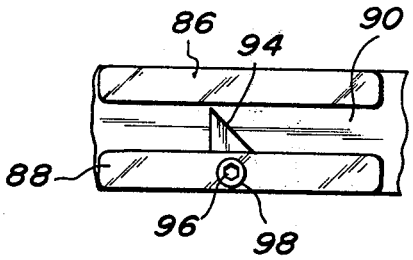
FIG. 9 is a fragmentary top plan view of the slide portion of the tool of FIG. 1 with the slide portion advanced to the right of FIG. 1.

Pawl 94, as is shown in FIGS. 6 and 7, has a pivot pin 96 which is free to move in an aperture 98 in upstanding member 88 and thus permits the pawl 94 to move from the non-exposed position shown in FIG. 1 where it cannot engage a strap placed between upstanding members 86, 88 to the exposed position as shown in FIG. 9 where it can engage such a strap.

A knife-edge 100 engages a strap securely and by the combination of biting into the strap surface and pressing the strap against upstanding member 86 the strap is pulled into the tool 20 as the slide portion 40 moves to the right, as shown in FIG. 14.

Pawl 94, as is shown in FIGS. 6 and 7, has an extension 102 thereon about which is placed a compression return spring 104 which tends to bias the pawl 94 to the front edge 93 of the aperture 92 when the pawl 94 is not otherwise restrained, as will be disclosed below. Spring 104 also tends to keep the left end of pawl 94, as seen in FIG. 7, forward and prevent any unwanted locking or wedging of pawl 94 against the walls of aperture 92.

Figure 8:
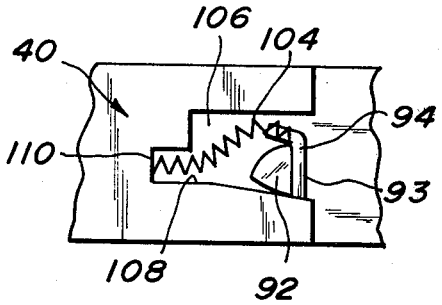
FIG. 8 is a fragmentary bottom plan view of the slide portion of the tool of FIG. 1 showing the pawl assembly.

As is best seen in FIG. 8 which is a bottom view of the slide portion pawl zone there is a first recess 106 and a second recess 108 having an end wall 110. Compression pawl return spring 104 is butted against end wall 110 and is retained in recess 108 and 106 to extension 102. The assembly of the slide portion 40 and the base portion 22 retain the spring 104 in position and provide a bearing surface for end 112 of the pawl 94 as it rotates within aperture 92.

Figure 10:
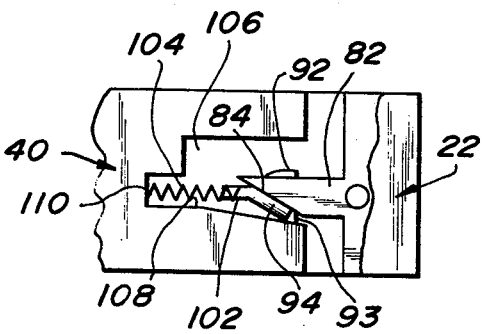
FIG. 10 is a fragmentary bottom view of the pawl assembly of FIG. 8 shown in full engagement with the nose piece of FIG. 5 shown reversed.
Figure 11:
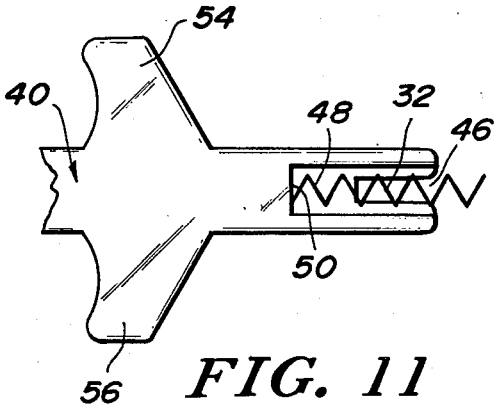
FIG. 11 is a fragmentary bottom plan view of the slide portion of the tool of FIG. 1 showing the slide return spring.

Turning now to FIG. 10 there is shown the structure of FIG. 8 with the pawl operating lever 82 of transverse plate 74 shown. This would be the position which the parts occupy when the tool 20 is in its initial position and slide portion 40 is at the extreme left as is shown in FIG. 1 due to return spring 32 (see FIGS. 11 and 12). The leading edge 84 of the pawl operation lever 82 engages pawl 94 so that it is fully retracted from the passageway between upstanding arms 86, 88. As the slide portion 40 is moved to the right in FIG. 14, the pawl 94 is withdrawn from contact with leading edge 84 of pawl operating lever 82 and the compressed spring 104 is permitted to return the pawl 94 towards the position shown in FIG. 8.

Figure 13:
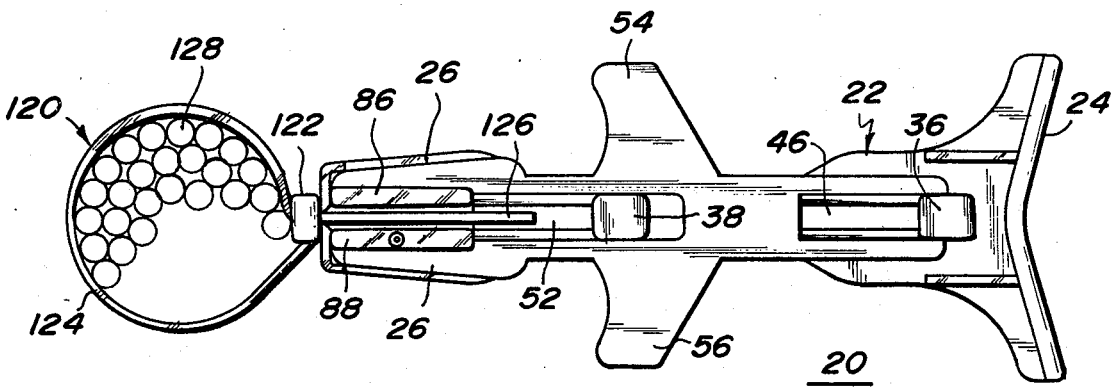
FIG. 13 is a top plan view of the tool of FIG. 1 before the tool is operated.

In operation, with the tool 20 in the initial position as shown in FIG. 13, lying in the palm of either hand with the recess between markers 86, 88 fully visible and accessable a strap 120 having a head 122 with an aperture therethrough and a locking mechanism therein, and a strap body 124 terminating in a tail end portion 126 is looped about a plurality of articles 128 to be bundled and drawn up sufficiently to provide sufficient strap body 124 to be inserted into tool 20. The tool 20 is positioned so that the face of the head 122 is positioned against nose piece 58 and the strap body 124 allowed to extend through slot 62 and between the upstanding members 86, 88 of the pawl zone of slide portion 40. The strap body 124 is not grasped by the pawl 94 because of the engagement of pawl 94 with pawl operating lever 82. The strap body 124 is positioned in tool 20 while the tool rests loosely in the palm of the operator's other hand. Now by applying pressure to the finger grips 54, 56 of the slide portion 40 sufficient to overcome return spring 32, the slide portion begins to move right as in FIG. 14 moving pawl 94 away from the inclined leading edge 84 of pawl operating lever 82 and permitting spring 104 to rotate the knife edge 100 of pawl 94 to contact the strap body 124. Further movement to the right by slide portion 40 now pulls the strap body 124 further into the tool 20 and tightens the loop about the articles 128. During such movement of slide means 40 the strap body 124 is fully visible and the tightening operation can be visually inspected. Since the strap 120 is self locking it will lock at the position drawn to. The operator may make additional tightening strokes by relaxing the pressure on finger grips 54, 56 and allowing spring 32 to return slide portion 40 to the left of FIG. 14. The pawl 94 will move over the strap body 124 impeded only by return spring 104. When the slide portion 40 reaches the critical position as shown in FIGS. 1 and 13, the pawl 94 is fully open, as was described above, to grip the strap body 124 for a further cycle of tightening.

Once the operator determines that the strap 120 is tight enough about the articles 128 then the tool 20 can be rotated in either a clockwise or counterclockwise direction about the longitudinal axis of tool 20 to bring either of the sharpened edges 64, 66 into contact with the strap body 124 and nick and sever the strap body 124 adjacent the front face of head 122. By contouring the nose piece 58 properly the cut can be made to take place at the front face of the head, inside the head or beyond the head of the strap. Once the finger grips 54, 56 are released, spring 32 will return the slide portion 40 to its initial position as shown by FIGS. 1 and 13 allowing the pawl 94 to be withdrawn and the severed strap body 124 and tail end portion 126 to be removed from tool 20.

While there have been shown and described and pointed out the fundamental novel features of the invention as applied to the preferred embodiment, it will be understood that various omissions and substitutions and changes of the form and details of the device illustrated and in its operation may be made by those skilled in the art, without departing from the spirit of the invention.

The embodiments of the invention in which an exclusive property or privilege is claimed are defined as follows:

1. A tool for tightening the loop formed about a plurality of articles to be bundled by a strap having an elongate body portion extending between a head and a tail, said loop being formed by passing the tail and body portion through said head after being passed about said articles, said tool further being able to selectively sever the portion of said body portion extending beyond said head when said loop is sufficiently tight comprising: a base portion having a nose end, a tail end and a generally planar portion therebetween; stock means coupled to and generally transverse to said base portion tail end for engagement with a portion of the hand of an operator; guide means coupled to and extending normal to the plane of said planar portion of said base portion intermediate said nose end and tail end; slide means having a nose portion and a tail portion and a generally planar portion therebetween to overlie said base portion planar portion, said nose portion and said tail portion respectively positioned adjacent said nose end and said tail end; guide means receivers in said planar portion of said slide means to receive therein said guide means of said base portion and guide the movement of said slide means along said planar portion of said base portion; finger grips coupled to said slide means and engageable by the fingers of an operator; and a recess in said slide means nose portion normal to the plane of said slide means for the receipt therein of the tail and body portion of said strap; strap gripping means adjacent the nose portion of said slide means for engaging the tail and body portion of a strap inserted within said recess of said slide means and causing said loop to be tightened as said slide means is moved towards a second position with said tail portion adjacent said tail end by the application of pressure by an operator upon said finger grips towards said stock; spring return means coupled between said body portion and said slide means for returning said slide means to a first position with said nose portion adjacent said nose end once the operator pressure has been removed; release means on said base portion adjacent said nose end for engaging said strap gripping means when said slide means is in said first position to release said gripping means from a strap body portion placed therein; nose means coupled to said base portion nose end and having a slot therein, at least partially aligned with the recess in said slide means and proportioned to permit the tail and body portion of a strap to pass therethrough into the recess of said slide means in a direction normal to the plane of said planar portion of the base portion; the edges of said nose means defining the slot normal to the plane of said planar portion being sharpened to permit the excess of the strap body portion beyond said head, once the loop has been tightened to a desired tension, to be severed by the rotating of said tool clockwise or counterclockwise about the longitudinal axis of said base portion causing said strap body portion to engage the sharpened edges of said slot.

2. A tool as defined in claim 1 wherein said spring return means is located partially in a first channel in said planar portion of said base portion and partially in a second channel in said planar portion of said slide means whereby said spring return means is retained entirely within said planar portion of said base portion and said planar portion of said slide portion.

3. A tool as defined in claim 1 wherein said nose means and said release means are integral.

4. A tool as defined in claim 1 wherein said guide means have a generally T-shape and said guide means receivers have a generally complementary T-shape.

* * * * *

UNITED STATES PATENT AND TRADEMARK OFFICE

CERTIFICATE OF CORRECTION

PATENT NO. : 3,993,109

DATED : November 23, 1976

INVENTOR(S) : William A. Fortsch

It is certified that error appears in the above-identified patent and that said Letters Patent are hereby corrected as shown below:

Column 3, line 23, "38", should be -- 28 --

Column 3, line 26, "AT", should be -- An --

Column 6, line 17, after and insert -- said --

Column 6, line 27, delete and

Signed and Sealed this

Eighth Day of February 1977

[SEAL]

*Attest:*

RUTH C. MASON
*Attesting Officer*

C. MARSHALL DANN
*Commissioner of Patents and Trademarks*